US009666174B2

(12) United States Patent
Calisi et al.

(10) Patent No.: US 9,666,174 B2
(45) Date of Patent: May 30, 2017

(54) SYSTEM AND METHOD FOR DEFINED AREA SOUND MASKING

(71) Applicant: Cambridge Sound Management, Inc., Waltham, MA (US)

(72) Inventors: Christopher Calisi, Middleton, MA (US); Gregory Saunders, Worcester, MA (US); Mitchell Nollman, Brighton, MA (US); Gordon V. Cook, Acton, MA (US); Thomas R. Horrall, Harvard, MA (US); Stephen Shenefield, Arlington, MA (US)

(73) Assignee: Cambridge Sound Management, Inc., Waltham, MA (US)

( * ) Notice: Subject to any disclaimer, the term of this patent is extended or adjusted under 35 U.S.C. 154(b) by 0 days.

(21) Appl. No.: 15/083,452

(22) Filed: Mar. 29, 2016

(65) Prior Publication Data

US 2016/0293155 A1 Oct. 6, 2016

Related U.S. Application Data

(60) Provisional application No. 62/142,761, filed on Apr. 3, 2015.

(51) Int. Cl.
*H04R 3/02* (2006.01)
*G10K 11/16* (2006.01)
(Continued)

(52) U.S. Cl.
CPC ..... *G10K 11/175* (2013.01); *H04R 1/028* (2013.01); *H04R 1/323* (2013.01); *H04R 9/06* (2013.01); *H04K 3/82* (2013.01)

(58) Field of Classification Search
CPC ..... G10K 11/175; H04K 3/82; H04R 1/028; H04R 1/323; H04R 9/06
(Continued)

(56) References Cited

U.S. PATENT DOCUMENTS 5,315,661 A * 5/1994 Gossman ..... G10K 11/1788 381/71.1
5,383,562 A * 1/1995 Gay ..... A47B 55/02 108/109
(Continued)

FOREIGN PATENT DOCUMENTS

JP 2011-154126 A 8/2011
WO WO 2016/160764 A1 10/2016

OTHER PUBLICATIONS

Lencore: "Spectra i.Net Enginered system solutions for sound masking, Paging & audio", (Jan. 1, 2013), XP055281636, Retrieved from the Internet: URL: http://www.oeler.com/download/lencoreinet-product-brochure-2/7wpdmd1=4381 [retrieved on Jun. 17, 2016].
(Continued)

*Primary Examiner* — Khai N Nguyen
(74) *Attorney, Agent, or Firm* — Hamilton, Brook, Smith & Reynolds, P.C.

(57) ABSTRACT

In accordance with an embodiment of the invention, a sound masking system is used to produce a sound masking zone in the vicinity of a defined area, for example in an area surrounding a conference room, an area within a medical office, or an area within a place of worship. A screen of loudspeakers around the defined area is used to create the sound masking zone. An indicator light, outside the defined area and unique to the sound masking zone around the defined area, is used to indicate that the sound masking system is active or ramping up.

29 Claims, 6 Drawing Sheets

(51) Int. Cl.

| | |
|---|---|
| ***A61F 11/06*** | (2006.01) |
| ***H03B 29/00*** | (2006.01) |
| ***G10K 11/175*** | (2006.01) |
| ***H04R 1/02*** | (2006.01) |
| ***H04R 1/32*** | (2006.01) |
| ***H04R 9/06*** | (2006.01) |
| *H04K 3/00* | (2006.01) |

(58) Field of Classification Search
USPC ..... 381/71.1, 71.4, 71.7, 73.1, 94.1, 96
See application file for complete search history.

(56) References Cited

U.S. PATENT DOCUMENTS

| | | | | |
|---|---|---|---|---|
| 5,781,640 | A * | 7/1998 | Nicolino, Jr. | G10K 15/02 381/71.13 |
| 7,194,094 | B2 * | 3/2007 | Horrall | G10K 11/175 381/73.1 |
| 8,666,086 | B2 * | 3/2014 | Moeller | G10K 11/175 381/73.1 |
| 9,076,430 | B2 * | 7/2015 | Horrall | G10K 11/175 |
| 2003/0002692 | A1 * | 1/2003 | McKitrick | H04R 5/023 381/94.1 |
| 2003/0091199 | A1 * | 5/2003 | Horrall | G10K 11/175 381/73.1 |
| 2003/0219133 | A1 * | 11/2003 | Horrall | G10K 11/175 381/73.1 |
| 2005/0015252 | A1 * | 1/2005 | Marumoto | G10L 21/02 704/234 |
| 2007/0133816 | A1 * | 6/2007 | Horrall | G10K 11/175 381/73.1 |
| 2008/0157956 | A1 * | 7/2008 | Radivojevic | A61B 5/11 340/531 |
| 2009/0306798 | A1 * | 12/2009 | Moeller | G10K 11/175 700/94 |
| 2013/0163777 | A1 * | 6/2013 | Tashiro | G10K 11/175 381/73.1 |
| 2013/0163778 | A1 * | 6/2013 | Ito | G10K 11/175 381/73.1 |
| 2013/0163779 | A1 * | 6/2013 | Yamaguchi | G10K 11/175 381/73.1 |

OTHER PUBLICATIONS

Evoko: "Evoko Room Manager EVO", (Apr. 16, 2013), XP055281764, Retrieved from the Internet: URL:http://www.evoko.se/wp-content/uploads/2014/04/evoko_evo_eng1304161.pdf [retrieved on Z016:06-20].

Evoko: "Marketing-Leitfaden zum Evoko Room Manager. Touch. Schedule. Meet.", (Sep. 23, 2010), XP055281758, Retrieved from the Internet: URL:http://www.comm-tec.de/de/hersteller/evoko/bilder-und-dateien/marketingleitfaden.pdf [retrieved on Jun. 20, 2016].

Cambridge Sound Management: "Qt 100", (Jan. 1, 2013), XP055281575, Retrieved from the Internet: URL:http://cambridgesound.com/wp-content/uploads/2013/06/Qt100_Technical_Specs_web.pdf [retrieved on Jun. 17, 2016].

International Search Report and Written Opinion of the International Searching Authority for International Application No. PCT/US2016/024635, entitled: "System and Method for Defined Area Sound Masking With Exterior Visual Status Indicator", Date of Mailing: Jun. 28, 2016.

* cited by examiner

SYSTEM AND METHOD FOR DEFINED AREA SOUND MASKING

RELATED APPLICATION

This application claims the benefit of U.S. Provisional Application No. 62/142,761, filed on Apr. 3, 2015, the entire teachings of which application are incorporated herein by reference.

BACKGROUND

Freedom from distraction is an important consideration for workers' satisfaction with their office environment, and, in order to reduce the intelligibility of unwanted speech overheard in various office configurations, sound masking systems have been used. However, there is an ongoing need to increase users' acceptance of sound masking systems; to increase the usage of sound masking systems in setting other than offices; to improve their aesthetic appearance and integration with other systems in environments in which they are used; and/or to improve other characteristics of sound masking systems.

SUMMARY OF THE INVENTION

In accordance with an embodiment of the invention, a sound masking system is used to produce a sound masking zone in the vicinity of a defined area, for example in an area surrounding a conference room, an area within a medical office, or an area within a place of worship. A screen of loudspeakers around the defined area is used to create the sound masking zone. An indicator light, outside the defined area and unique to the sound masking zone around the defined area, is used to indicate that the sound masking system is active or ramping up.

In one embodiment according to the invention, there is provided a sound masking system for providing a sound masking signal surrounding at least a portion of a defined area of a building. The system comprises a plurality of loudspeaker assemblies, each loudspeaker assembly coupled to one or more sources of an electrical sound signal, the electrical sound signal comprising a sound masking signal. Each of the plurality of loudspeaker assemblies is operative to emit an acoustic sound signal in response to the electrical sound signal, the acoustic sound signal comprising, during activation of a sound masking function of the sound masking system, an acoustic sound masking signal. Each of the plurality of loudspeaker assemblies is constructed and oriented to provide the acoustic sound signal to a zone surrounding the at least a portion of the defined area of the building. An exterior indicator panel positioned outside the defined area of the building, is configured to provide an exterior visual indication, during activation of the sound masking function of the sound masking system, that the acoustic sound masking signal is being emitted into the zone surrounding the at least a portion of the defined area of the building. The exterior indicator panel is configured to provide the exterior visual indication uniquely for sound masking of the zone surrounding the at least a portion of the defined area of the building.

In further, related embodiments, the exterior indicator panel may be positioned in the zone surrounding the at least a portion of the defined area of the building. The exterior indicator panel may be electrically or wirelessly coupled to a control module comprising the one or more sources of the electrical sound signal. The defined area of the building may comprise a room within the building. For example, the defined area of the building may comprise at least one of: a conference room; a portion of a place of worship; a portion of a medical facility; a portion of a pharmaceutical facility; a portion of a judicial facility; and a portion of a government office. The sound masking system may further comprise an interior indicator panel positioned inside the defined area of the building, configured to provide an interior visual indication, during the activation of the sound masking function of the sound masking system, that the acoustic sound masking signal is being emitted into the zone surrounding the at least a portion of the defined area of the building. The acoustic sound masking signal may comprise a system warmup acoustic sound masking signal during an initial warmup time upon activation of the sound masking function of the sound masking system; and the exterior indicator panel may be further configured to provide a system warmup visual indication during the initial warmup time interval.

The system warmup acoustic sound masking signal may comprise a ramping volume sound masking signal over the initial warmup time. The acoustic sound masking signal may comprise a sound pressure level of 42 dBa or less during activation of the sound masking function of the sound masking system.

In other related embodiments, the sound masking system may comprise a direct field sound masking system for the zone surrounding the at least a portion of the defined area of the building, wherein each of the plurality of loudspeaker assemblies has a voice coil coupled to an audio emitter operative to emit the acoustic sound masking signal, wherein each said audio emitter is a cone emitter, wherein each of the plurality of loudspeaker assemblies has a low directivity index, and wherein each of the plurality of loudspeaker assemblies is constructed and oriented to provide the acoustic sound masking signal in a direct path to the ears of a listener in the defined area of the building. The audio emitter may have an effective aperture area that is less than or equal to the area of a circle having a diameter of 3.0 inches; or that is less than or equal to the area of a circle having a diameter of 1.5 inches; or that is equal to the area of a circle having a diameter of between 1.25 inches and 3 inches.

In further related embodiments, the exterior visual indication may comprise an illuminated light, or a graphical notification on an electronic display. The electronic display may be in communication with a scheduling system for the defined area of the building. The sound masking system may be in electrical communication with an audiovisual system for the defined area of the building, and the sound masking function of the sound masking system may be configured to be activated by the audiovisual system. The audiovisual system may be further configured to activate at least one of a screen display in the defined area of the building, a set of room lights in the defined area of the building, and a data input for at least one computer in the defined area of the building. The sound masking system may be in electrical communication with a telecommunications system in the defined area of the building, and the sound masking function of the sound masking system may be configured to be activated by the telecommunications system. The sound masking system may be configured to be activated by a speaker phone button of the telecommunications system.

In other related embodiments, the sound masking system may further comprise an exterior indicator panel back box comprising (i) a mount configured to retain the exterior indicator panel, and (ii) a wall coupler configured to be coupled to a wall; or comprising (i) a mount configured to retain the exterior indicator panel, and (ii) an electrical connector configured to fit to a standard electrical outlet opening, such as a one-gang electrical opening. The sound masking system may comprise a control system back box comprising (i) a mount configured to retain a control system that comprises the one or more sources of the electrical sound signal, and (ii) a wall coupler configured to be coupled to a wall; or comprising (i) a mount configured to retain a control system that comprises the one or more sources of the electrical sound signal, and (ii) an electrical connector configured to fit to a standard electrical outlet opening, such as a three-gang or four-gang electrical opening.

In further related embodiments, the electrical sound signal may further comprise at least one of a music signal and a paging signal. The acoustic sound masking signal may have a corresponding sound masking spectrum, the sound masking spectrum having a low end frequency of at least about 80 Hz and a high end frequency of less than about 5300 Hz.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1:
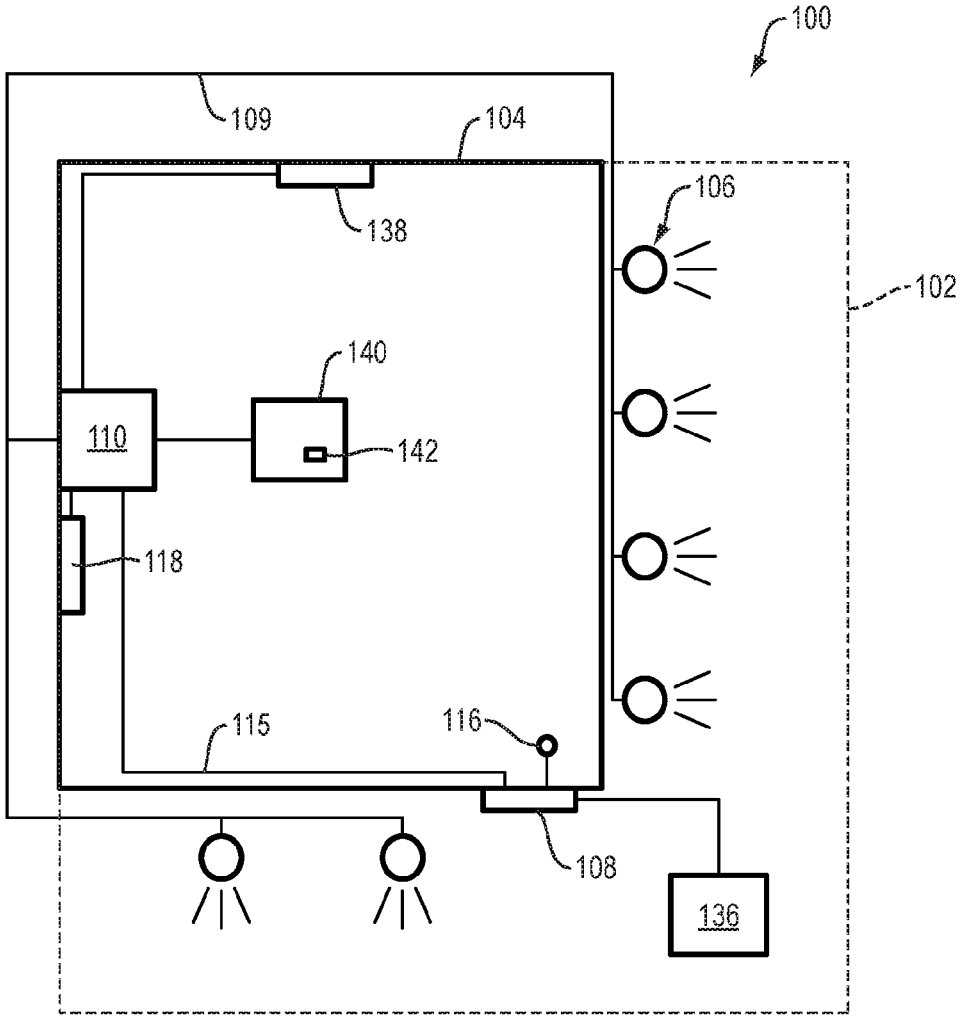
FIG. 1 is a schematic diagram of a sound masking system in accordance with an embodiment of the invention.

FIG. 1 is a schematic diagram of a sound masking system 100 in accordance with an embodiment of the invention. The sound masking system 100 is used to produce a sound masking zone 102 surrounding the outside of a defined area 104 of a building, such as a room within the building. For example, the zone 102 may surround a conference room, an area within a medical office or other medical facility, a portion of a pharmaceutical facility (such as a pharmacy), a portion of a judicial facility (such as courtroom or jury deliberation room), a portion of a government office, or an area within a place of worship. A screen of loudspeakers 106 around the defined area is used to create the sound masking zone 102. An exterior indicator panel 108, outside the defined area 104 and unique to the sound masking zone 102 around the defined area 104, is used to indicate that the sound masking system 100 is active or ramping up sound masking for the defined area 104. The sound masking zone 102 may surround only a portion of the defined area 104 of the building, or may surround the entire defined area 104 of the building. The screen of loudspeakers 106 are coupled via electrical connections 109 to a source 110 of an electrical sound signal, which includes a sound masking signal, and which may also include a music signal and/or a paging signal. The loudspeakers 106 emit an acoustic sound signal in response to the electrical sound signal, and, when the sound masking function of the sound masking system is activated, emit an acoustic sound masking signal. The loudspeakers 106 are constructed and oriented to provide the acoustic sound signal to the sound masking zone 102. For example, the loudspeakers 106 may be positioned facing downwards from a suspended ceiling, so as to transmit the sound masking signal directly to the ears of a listener in the sound masking zone 102.

Figure 2:
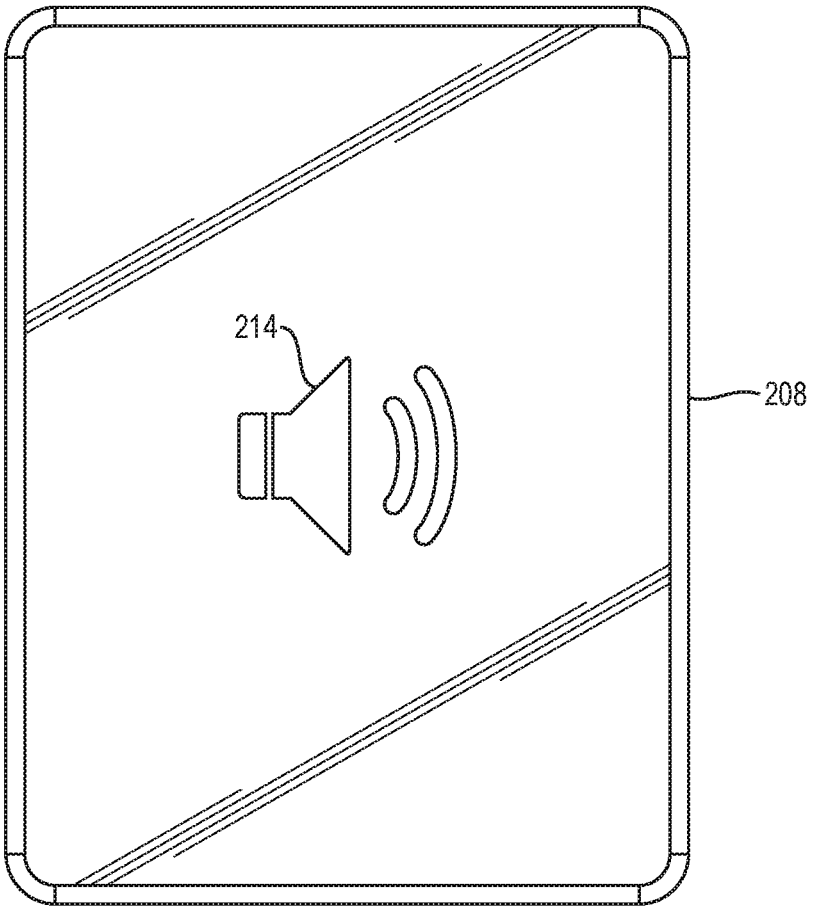
FIG. 2 is a front elevation view of an exterior indicator panel for a sound masking system in accordance with an embodiment of the invention.

FIG. 2 is a front elevation view of an exterior indicator panel 208 for a sound masking system in accordance with an embodiment of the invention. The exterior indicator panel 208 is positioned outside of the defined area 104 (see FIG. 1), and in particular may be positioned in the sound masking zone 102 that surrounds the outside of the defined area 104. For example, the exterior indicator panel 208 may be positioned on the outside of a conference room that constitutes the defined area 104. The exterior indicator light panel 208 provides an exterior visual indication 214 (see FIG. 2), during activation of the sound masking function of the sound masking system 100, that the acoustic sound masking signal is being emitted into the sound masking zone 102. The exterior visual indication 214 may, for example, consist of illuminating a loudspeaker light emitting element 214, as shown in FIG. 2, or another illuminated light; or may consist of a graphical notification on an electronic display, such as a computer monitor or other screen positioned outside the defined area 104. The exterior indicator light panel 208 can be electrically coupled via electrical connection 115 to the source 110 of the electrical sound signal 112, or wirelessly coupled to it, for example using wireless transceiver 116. In one example, the exterior light panel 208 receives a 5 V signal from the source 110 of the electrical sound signal 112 that is indicative of whether the sound masking function of the sound masking system is activated.

In accordance with an embodiment of the invention, the exterior light panel 208 provides the exterior visual indication 214 uniquely for the particular sound masking zone 102 surrounding the defined area 104; that is, it does not, for example, provide an exterior visual indication 214 for any other sound masking zones elsewhere in the building. In this way, persons in the vicinity of the sound masking zone 102 can readily tell whether sound masking is activated for the defined area 104. In addition, as shown in FIG. 1, an interior indicator panel 118, which may take the same forms as described above for the exterior indicator panel 208 of FIG. 2, can be provided inside the defined area 104. The interior indicator panel 118 can function in a similar fashion to the exterior indicator panel 208, except with the intention of providing a visual indication to persons inside the defined area 104 regarding whether the sound masking signal is being emitted into the sound masking zone 102.

In accordance with an embodiment of the invention, the source 110 of the electrical sound signal may function to produce a system warmup acoustic sound masking signal, during an initial warmup time upon activation of the sound masking function of the sound masking system 100. This warmup time may help to make the system less obtrusive for persons in the vicinity of the sound masking system 100. For example, the system warmup acoustic sound masking signal may comprise a ramping volume sound masking signal over the initial warmup time. A warmup time of, for example, one minute may be used. During this time, the exterior indicator panel 208, and/or the interior indicator panel 118, may be configured to provide a system warmup visual indication. For example, the system warmup visual indication may be a flashing of the exterior visual indication 214, such as a flashing of loudspeaker-shaped light emitting element 214 of FIG. 2. One the warmup time is completed, the exterior visual indication 214 may transition to a different state that indicates full activation of the sound masking function of the sound masking system 100, such as by constant illumination of loudspeaker-shaped light emitting element 214 of FIG. 2 during the activation of the sound masking function. In addition to the warmup time, the system may also be made less obtrusive by operating at a lower sound pressure level than other sound masking systems; for example, the acoustic sound masking signal may comprise as sound pressure level of 42 dBa or less during activation of the sound masking function of the sound masking system 100. The system 100 may also operate using a "resting" output of the acoustic sound masking signal, which is at a lower volume than when the system is fully activated, but which is not fully off. The ramping volume of the warmup sound masking signal may start at the "resting" volume and ramp up to the full volume that is used during active sound masking.

For an acoustic sound masking signal, a sound masking system in accordance with an embodiment of the invention may use a sound masking spectrum based on the principles of the spectrum described in L. L. Beranek, "Sound and Vibration Control," McGraw-Hill, 1971, Page 593, the teachings of which reference are incorporated by reference in their entirety. The low end frequencies of the selected spectrum preferably comprise at least one of 50 Hz, 80 Hz and 100 Hz, most preferably 80 Hz. The high end frequencies are preferably less than 8 kHz and more preferably about 5300 Hz or less. It will be appreciated that other sound masking spectra may be used.

Figure 3:
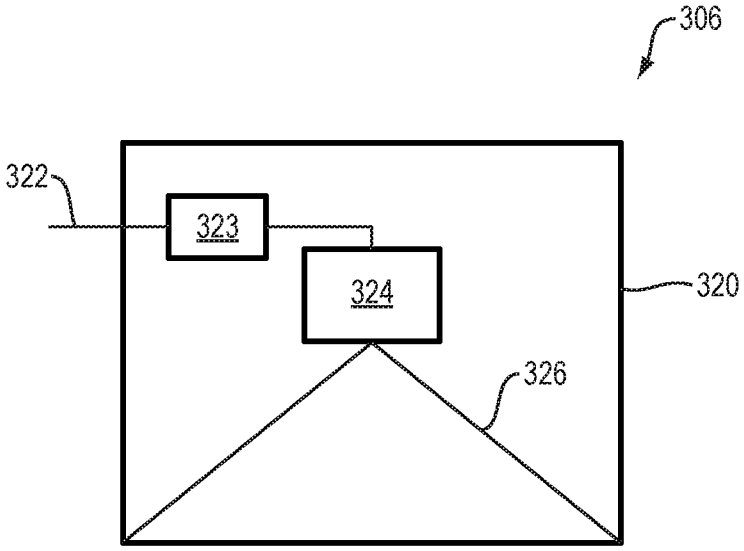
FIG. 3 is a schematic diagram of a loudspeaker assembly in a sound masking system in accordance with an embodiment of the invention.
Figure 4:
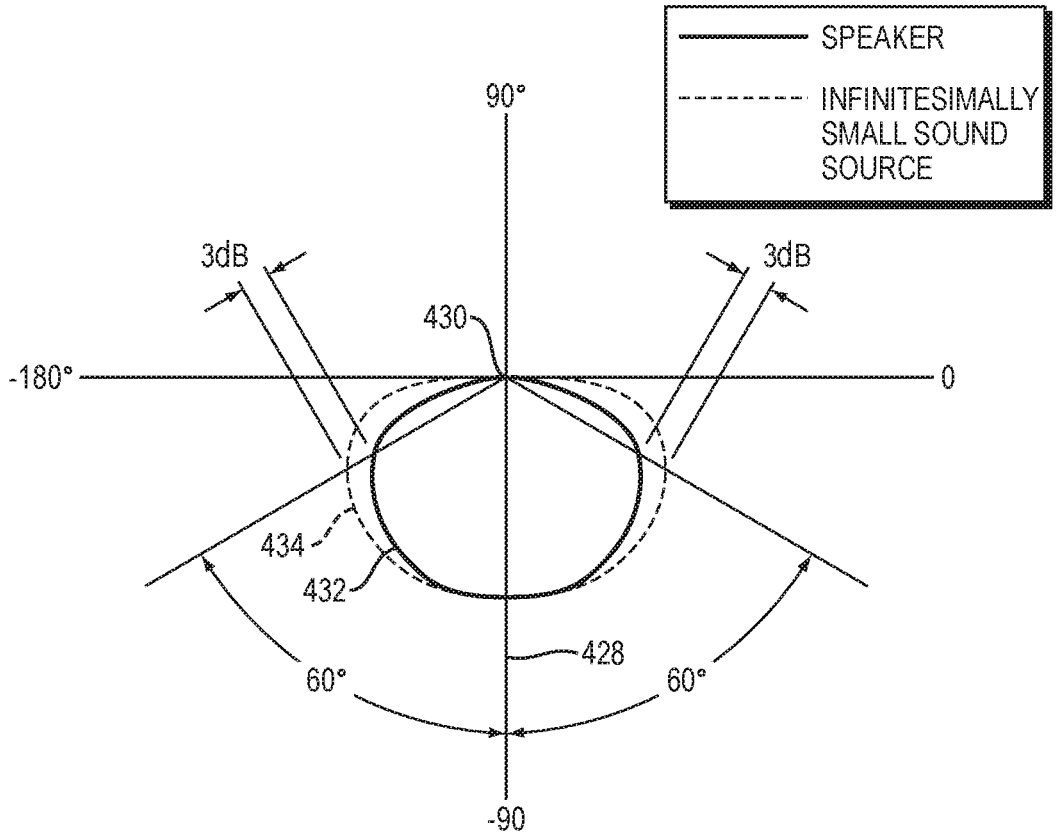
FIG. 4 is a polar plot of the output sound intensity from a loudspeaker that may be used in a sound masking system in accordance with an embodiment of the invention, as compared to the output sound intensity of an infinitesimally small sound source in an infinite baffle.

FIG. 3 is a schematic diagram of a loudspeaker assembly 306 in a sound masking system in accordance with an embodiment of the invention. The loudspeaker assembly 306 includes a substantially airtight case 320, an input connection 322, an input network 323 and a voice coil 324 that is coupled to audio emitter 326, which can be a cone emitter. The audio emitter 326 is operative to emit the acoustic sound masking signal. The cone loudspeaker assembly 306 may comprise a low directivity index loudspeaker. In one embodiment, all of the loudspeaker assemblies 106 (see FIG. 1) in the sound masking system may be low directivity index loudspeakers. Returning to FIG. 3, a loudspeaker assembly 306 can have a cone emitter 326 having an effective aperture area that is less than or equal to the area of a circle having a diameter of 3.0 inches; or that is less than or equal to the area of a circle having a diameter of 1.5 inches; or that is equal to the area of a circle having a diameter of between 1.25 inches and 3 inches; and may be of a type that is suitable to function as a direct field, low directivity index cone loudspeaker, such as the type taught in U.S. Pat. No. 7,194,094 B2 of Horrall et al., the teachings of which patent are incorporated by reference in their entirety. As used herein, a "direct field sound masking system" is one in which the acoustic sound masking signal or signals, propagating in a direct audio path from one or more emitters, dominate over reflected and/or diffracted acoustic sound masking signals in the sound masking zone. A "direct audio path" is a path in which the acoustic masking signals are not reflected or diffracted by objects or surfaces and are not transmitted through acoustically absorbent surfaces within a masking area or zone. A loudspeaker with a "low directivity index" is one that, with reference to the axial direction 428 of the speaker, at location 430 provides an output sound intensity 432 at an angle of 20 degrees, preferably 45 degrees, and most preferably 60 degrees from the axial direction, that is not more than 3 dB, and not less than 1 dB, lower than the output sound intensity 434 at the same angle from an infinitesimally small sound source at the same location in an infinite baffle at frequencies less than 6000 Hz, as measured in any one-third octave band. Accordingly, the low directivity index loudspeakers provide a substantially uniform acoustic output that extends nearly 180 degrees, i.e., plus or minus 90 degrees from the axial direction of the loudspeaker assembly.

Returning to the embodiments of FIGS. 1 and 2, when the exterior visual indication 214 consists of a graphical notification on an electronic display, which in this case constitutes the exterior indicator panel 108, such an electronic display may be in communication with a scheduling system 136 for the defined area 104. For example, the exterior indicator panel 108 may be in communication with a system 136 that determines what meeting is scheduled for a conference room that constitutes the defined area 104, and displays that meeting on the exterior indicator panel 108. In this way, the exterior visual indication 214 can be integrated with a scheduling system 136 for the defined area. In addition, the sound masking system 100 can be in electrical communication with an audiovisual system 138 for the defined area 104. The sound masking function of the sound masking system 100 may be configured to be activated by the audiovisual system 138. For example, the audiovisual system 138 may be configured to activate a screen display, a set of room lights, a data input for one or more computers, and/or the sound masking system 100. In one example, all of the foregoing may be activated simultaneously. In another embodiment, the sound masking system can be in electrical communication with a telecommunications system 140 in the defined area 104, and the sound masking system 100 may be configured to be activated by the telecommunications system 140. For example, the sound masking system may be configured to be activated by a speaker phone button 142 of the telecommunications system 140.

Figure 5A:
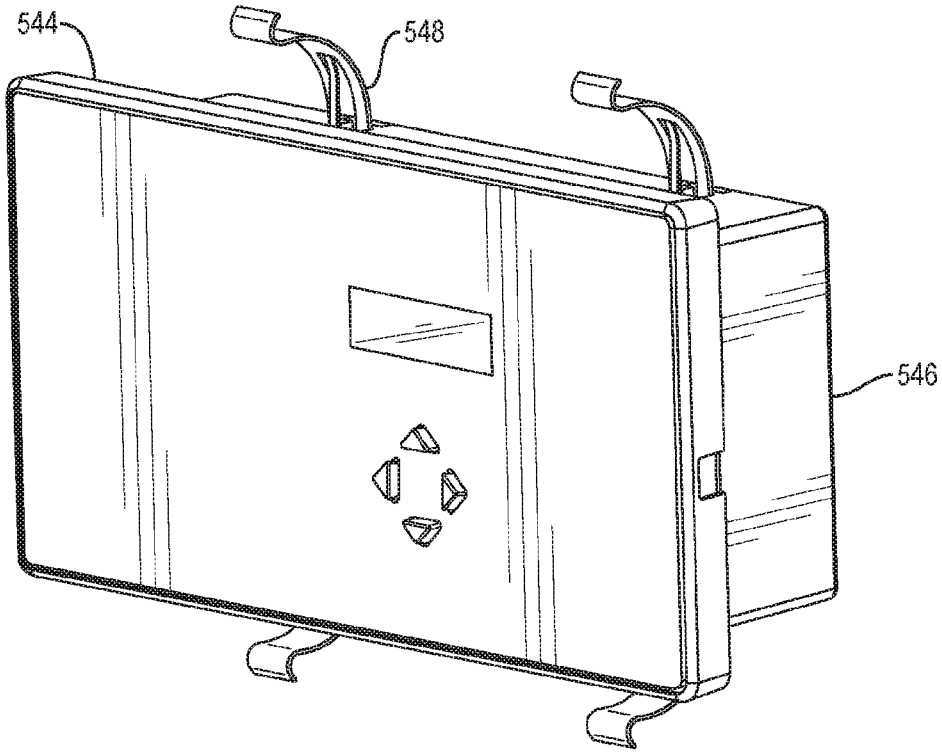
FIG. 5A is a front view.
Figure 5B:
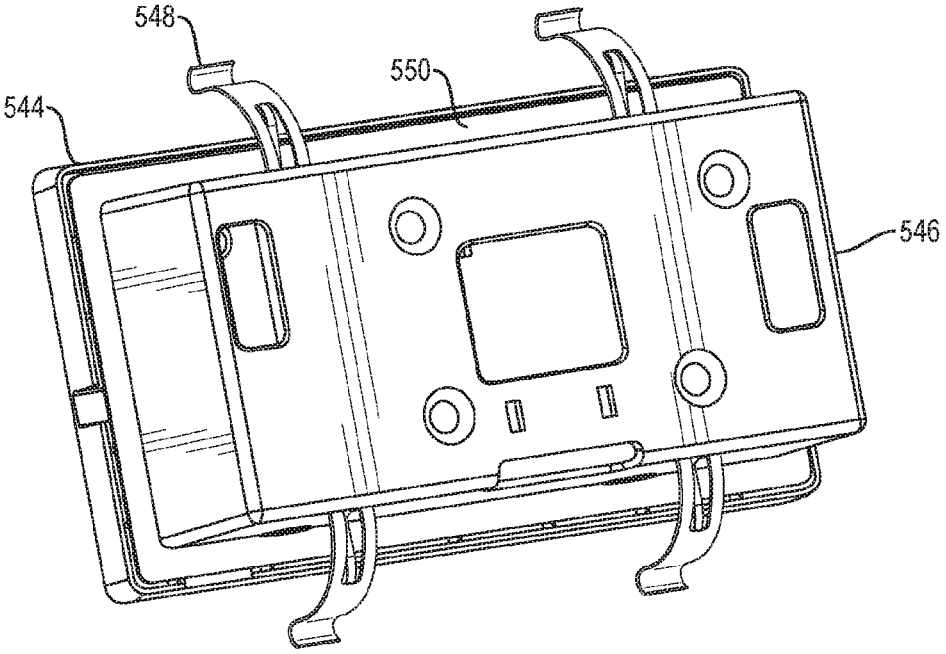
FIG. 5B is a rear view, of a control system with a back box comprising a wall coupler, in a sound masking system in accordance with an embodiment of the invention.

In accordance with an embodiment of the invention, the source 110 of the electrical sound signal can be characterized as a portion of a control system. It will be appreciated that the control system can include a microprocessor or other suitable circuitry to implement the control, automation, communication and other computing functions necessary to configure embodiments taught herein. The control system, exterior indicator panel 108, and interior indicator panel 118 can all be mounted either directly into a wall, or in standard electrical openings in walls. FIG. 5A is a front view, and FIG. 5B is a rear view, of a control system 544 with a back box 546 comprising a wall coupler 548, in a sound masking system in accordance with an embodiment of the invention. The back box 546 comprises a mount 550 configured to retain the control system 544, which comprises the source 110 of the electrical sound signal. The wall coupler 548 may, for example, be configured to penetrate drywall.

Figure 6A:
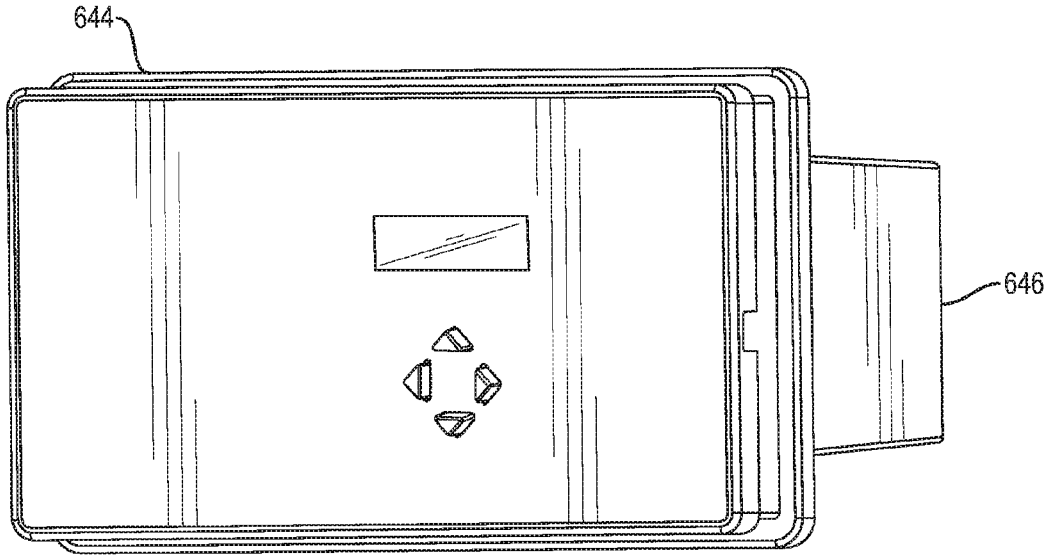
FIG. 6A is a front view.
Figure 6B:
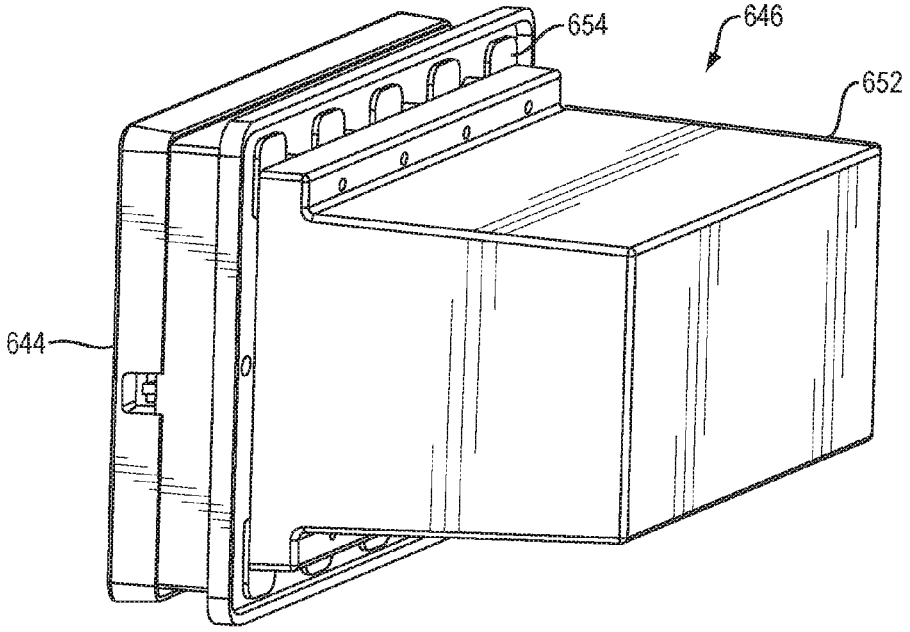
FIG. 6B is a rear view, of a control system with a back box comprising an electrical connector, in a sound masking system in accordance with an embodiment of the invention.

FIG. 6A is a front view, and FIG. 6B is a rear view, of a control system 644 with a back box 646 comprising an electrical connector 652, in a sound masking system in accordance with an embodiment of the invention. The back box 646 comprises a mount 654 configured to retain the control system 644, and an electrical connector 652 configured to fit to a standard electrical outlet opening, such as a three-gang or four-gang electrical opening.

It will be appreciated that similar mounting techniques to those shown in FIGS. 5A-6B can be used for the exterior indicator panel 108, and interior indicator panel 118 in accordance with an embodiment of the invention, although different size electrical outlet openings may be used, such as one-gang electrical openings.

The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed is:

1. A sound masking system for providing a sound masking signal surrounding at least a portion of a defined area of a building, the system comprising:

a plurality of loudspeaker assemblies, each loudspeaker assembly coupled to one or more sources of an electrical sound signal, the electrical sound signal comprising an electrical sound masking signal, wherein each of the plurality of loudspeaker assemblies is operative to emit an acoustic sound signal in response to the electrical sound signal, the acoustic sound signal comprising, during activation of a sound masking function of the sound masking system, an acoustic sound masking signal;

wherein each of the plurality of loudspeaker assemblies is constructed and oriented to provide the acoustic sound signal to a zone surrounding the at least a portion of the defined area of the building; and an exterior indicator panel positioned outside the defined area of the building, configured to provide at least an exterior visual indication, activated upon transition to full activation of the sound masking function and providing the exterior visual indication during full activation of the sound masking function of the sound masking system, that the acoustic sound masking signal is being emitted into the zone surrounding the at least a portion of the defined area of the building;

wherein the exterior indicator panel is configured to provide the exterior visual indication uniquely for sound masking of the zone surrounding the at least a portion of the defined area of the building.

2. The sound masking system of claim 1, wherein the exterior indicator panel is positioned in the zone surrounding the at least a portion of the defined area of the building.

3. The sound masking system of claim 1, wherein the exterior indicator panel is electrically coupled to a control module comprising the one or more sources of the electrical sound signal.

4. The sound masking system of claim 1, wherein the exterior indicator panel is wirelessly coupled to a control module comprising the one or more sources of the electrical sound signal.

5. The sound masking system of claim 1, wherein the defined area of the building comprises a room within the building.

6. The sound masking system of claim 1, wherein the defined area of the building comprises at least one of: a conference room; a portion of a place of worship; a portion of a medical facility; a portion of a pharmaceutical facility; a portion of a judicial facility; and a portion of a government office.

7. The sound masking system of claim 1, further comprising an interior indicator panel positioned inside the defined area of the building, configured to provide an interior visual indication, during the activation of the sound masking function of the sound masking system, that the acoustic sound masking signal is being emitted into the zone surrounding the at least a portion of the defined area of the building.

8. The sound masking system of claim 1, wherein the acoustic sound masking signal comprises a system warmup acoustic sound masking signal during an initial warmup time upon activation of the sound masking function of the sound masking system, and wherein the exterior indicator panel is further configured to provide a system warmup visual indication during the initial warmup time interval.

9. The sound masking system of claim 8, wherein the system warmup acoustic sound masking signal comprises a ramping volume sound masking signal over the initial warmup time.

10. The sound masking system of claim 1, wherein the acoustic sound masking signal comprises a sound pressure level of 42 dBa or less during activation of the sound masking function of the sound masking system.

11. The sound masking system of claim 1, wherein the sound masking system comprises a direct field sound masking system for the zone surrounding the at least a portion of the defined area of the building, wherein each of the plurality of loudspeaker assemblies has a voice coil coupled to an audio emitter operative to emit the acoustic sound masking signal, wherein each said audio emitter is a cone emitter, wherein each of the plurality of loudspeaker assemblies has a low directivity index, and wherein each of the plurality of loudspeaker assemblies is constructed and oriented to provide the acoustic sound masking signal in a direct path to the ears of a listener in the defined area of the building.

12. The sound masking system of claim 11, wherein, said audio emitter has an effective aperture area that is less than or equal to the area of a circle having a diameter of 3.0 inches.

13. The sound masking system of claim 11, wherein said audio emitter has an effective aperture area that is less than or equal to the area of a circle having a diameter of 1.5 inches.

14. The sound masking system of claim 11, wherein said audio emitter has an effective aperture area that is equal to the area of a circle having a diameter of between 1.25 inches and 3 inches.

15. The sound masking system of claim 1, wherein the exterior visual indication comprises an illuminated light.

16. The sound masking system of claim 1, wherein the exterior visual indication comprises a graphical notification on an electronic display.

17. The sound masking system of claim 16, wherein the electronic display is in communication with a scheduling system for the defined area of the building.

18. The sound masking system of claim 1, wherein the sound masking system is in electrical communication with an audiovisual system for the defined area of the building, and wherein the sound masking function of the sound masking system is configured to be activated by the audiovisual system.

19. The sound masking system of claim 18, wherein the audiovisual system is further configured to activate at least one of a screen display in the defined area of the building, a set of room lights in the defined area of the building, and a data input for at least one computer in the defined area of the building.

20. The sound masking system of claim 1, wherein the sound masking system is in electrical communication with a telecommunications system in the defined area of the building, and wherein the sound masking function of the sound masking system is configured to be activated by the telecommunications system.

21. The sound masking system of claim 20, wherein the sound masking system is configured to be activated by a speaker phone button of the telecommunications system.

22. The sound masking system of claim 1, further comprising an exterior indicator panel back box comprising (i) a mount configured to retain the exterior indicator panel, and (ii) a wall coupler configured to be coupled to a wall.

23. The sound masking system of claim 1, further comprising an exterior indicator panel back box comprising (i) a mount configured to retain the exterior indicator panel, and (ii) an electrical connector configured to fit to a standard electrical outlet opening.

24. The sound masking system of claim 23, wherein the standard electrical outlet opening comprises a one-gang electrical opening.

25. The sound masking system of claim 1, further comprising a control system back box comprising (i) a mount configured to retain a control system that comprises the one or more sources of the electrical sound signal, and (ii) a wall coupler configured to be coupled to a wall.

26. The sound masking system of claim 1, further comprising a control system back box comprising (i) a mount configured to retain a control system that comprises the one or more sources of the electrical sound signal, and (ii) an electrical connector configured to fit to a standard electrical outlet opening.

27. The sound masking system of claim 26, wherein the standard electrical outlet opening comprises at least one of a three-gang electrical opening and a four-gang electrical opening.

28. The sound masking system of claim 1, wherein the electrical sound signal further comprises at least one of a music signal and a paging signal.

29. The sound masking system of claim 1, wherein the acoustic sound masking signal has a corresponding sound masking spectrum, said sound masking spectrum having a low end frequency of at least about 80 Hz and a high end frequency of less than about 5300 Hz.

* * * * *